United States Patent [19]

Behr et al.

[11] Patent Number: 4,698,954

[45] Date of Patent: Oct. 13, 1987

[54] GUIDE FOR ZIPPERED FILM IN A FORM, FILL AND SEAL PACKAGING MACHINE

[75] Inventors: R. Douglas Behr; Larry M. Zieke, both of Midland, Mich.

[73] Assignee: The Dow Chemical Company, Midland, Mich.

[21] Appl. No.: 889,551

[22] Filed: Jul. 25, 1986

[51] Int. Cl.[4] ..... B65B 9/06

[52] U.S. Cl. ..... 53/551; 53/389; 53/567; 493/345

[58] Field of Search ..... 53/389, 550, 551, 547, 53/567, 568, 451; 156/66, 152; 493/287, 345

[56] References Cited

U.S. PATENT DOCUMENTS

| | | | |
|---|---|---|---|
| 2,761,264 | 9/1956 | Gossett | 53/567 |
| 3,181,583 | 5/1965 | Lingerfelter . | |
| 3,314,210 | 4/1967 | Jarund | 53/175 |
| 3,492,775 | 2/1970 | Rhine et al. | 53/451 |
| 3,815,317 | 6/1974 | Toss . | |
| 4,024,010 | 5/1977 | Boccia . | |
| 4,094,729 | 6/1978 | Boccia . | |
| 4,481,754 | 11/1984 | Hannen | 53/567 |
| 4,528,224 | 7/1985 | Ausnit . | |
| 4,545,181 | 10/1985 | Frankefort . | |
| 4,571,235 | 2/1986 | Benoit . | |

*Primary Examiner*—Robert L. Spruill
*Assistant Examiner*—Donald R. Studebaker
*Attorney, Agent, or Firm*—L. E. Hessenaur, Jr.

[57] ABSTRACT

An apparatus is disclosed for providing uninterrupted guidance of a reclosable bag through a filling station in a form fill and seal system. The apparatus includes a guide mechanism positioned inside the bag film for providing uninterrupted guidance of the bag film through the filling station. The guide mechanism includes a first guide wheel for engaging the bottom of the bag film and a second guide wheel for engaging interlocked fastener elements on opposing plies of the bag film. A separating device is positioned along the path traveled by the bag film for separating the interlocked fastener elements as the bag film is advanced.

12 Claims, 4 Drawing Figures

GUIDE FOR ZIPPERED FILM IN A FORM, FILL AND SEAL PACKAGING MACHINE

BACKGROUND OF THE INVENTION

This invention relates to a machine for forming, filling, and sealing reclosable bags from a continuous web of bag material, and more particularly to a mechanism for guiding the bag film and separating the bag film's fastener elements in such a forming, filling, and sealing machine.

Bags of various types have been used for packaging a wide variety of products. For example, cereals, cookies, and potato chips are often packaged in bags. These bags can serve as the external packaging for the products, or can be inserted into boxes as a liner for the boxes. When packaging perishable materials such as cereal, cookies, and potato chips, the bags should be sealed, as sealed bags help to preserve the product contained therein by preventing the co-mingling of outside air and moisture with the product in the bags.

Conventional sealed bags (such as most cereal bags and potato chip bags) have seals which are formed by gluing together or heat sealing together a pair of opposed edges of the bags. One problem with such conventional sealed bags is that they cannot be resealed after being opened. Thus, once the bag is opened, the user cannot prevent the unwanted intrusion of outside air and moisture into the bag.

Reclosable bags are known. Usually, reclosable bags include a pair of fastener elements (such as a pair of rib and groove profiles or "zippers"), which the user fastens together after opening to thereby effectively seal the contents of the bag from the intrusion of unwanted air and moisture. One example of such a reclosable bag is the ZIPLOC® brand food storage bag manufactured by the Dow Chemical Company, the assignee of the instant application.

Both conventional and reclosable bags share a common feature in that they are usually formed from a continuous roll (web) of bag film. This bag film web is filled with the product (such as cereal) and the web is subdivided into a plurality of individual bags.

Machines for forming and filling bags from a continuous web of bag material are known.

Toss, U.S. Pat. No. 3,815,317 relates to a form, fill, and seal apparatus for use with zippered bags. A continuous web of bag film is fed to the apparatus. The continuous web of bag film has interlocked fasteners. The fasteners are disengaged, and the film spread apart to remove wrinkles. A pin unlocks the fasteners, while a guide device holds the fasteners apart. The fasteners are rejoined as they are pinched by closing rolls. The interlocked bag film is then cross-sealed and filled through the remaining open side. The final seam is then sealed and severed to provide the final structure. It should be noted that the mechanisms in the Toss structure which unlock and reclose the fasteners do so for the purpose of removing wrinkles or folds from the bag film. The filling of the bag itself is accomplished through an open side of the bag film. During the filling of the bag, the profiles are closed.

Boccia, U.S. Pat. Nos. 4,024,010 and 4,094,729 have a parent/divisional relationship. Boccia relates to an apparatus wherein two opposing film layers with interlocking rib and groove fasteners on opposing faces are separated so that a heat sealing of the side seams can be accomplished only in those areas where the fasteners remain interlocked. A separating finger opens the interlocked fastener elements. Grooves on the top and bottom of the separating finger are provided for maintaining the fastener elements in alignment.

One difficulty encountered in bag forming, filling and sealing operations is maintaining the bag film from which the bags are cut in a proper lateral alignment as the bag film travels through the forming, filling and sealing machine. This problem is especially acute in the forming, filling and sealing of fastener element containing recloseable bags.

Typically, reclosable bag film is wound on a roll in a helical pattern, wherein the fastener elements of adjacent layers on the roll are offset laterally from each other. Reclosable bag film is usually wound on a roll in this manner in order to form a roll having a more constant diameter throughout its width. If the bag film were not wound in this helical arrangement, the extra thickness of the fastener elements would cause the bag film roll to be much thicker in that area wherein the zippers were placed. The helical winding of the bag film roll makes it difficult to draw the web from the roll in a proper lateral alignment for entry into the forming, filling and sealing machine. As the web should be properly laterally aligned before the web is fed into the machine, means should be provided for laterally aligning the web prior to the web being fed into the forming, filling and sealing portions of the machine.

It is therefore an object of this invention to provide an improved bag film guiding and aligning means for a packaging machine.

SUMMARY OF THE INVENTION

In accordance with the present invention, a form, fill and seal packaging machine is provided. The packaging machine includes means for supplying a continuous plastic bag film having recloseable fastener elements on respective opposing plies of the film, and means for feeding the film through a filling station. A filling station is provided for supplying a predetermined amount of product to the bag film. Guide means are provided which immediately precede the filling station, and are positioned inside the bag film for providing uninterrupted guidance of the film through the filling station. A separating means precedes the filling station for separating the fastener elements. The packaging machine also includes means for pressing the fastener elements together in an interlocking relationship, and means for laterally sealing the bag film to form a bag assembly having first and second side seams. Means are also provided for severing the bag assembly from the bag film.

Preferably, the guide means includes a support arm, and a bracket member connected to the support arm and disposed between the plies of the bag film. A first guide wheel is rotatably coupled to the bracket member for engaging the bottom of the bag film, and a second guide wheel is rotatably coupled to the bracket member for engaging the fastener elements. The separating means can comprise a separating edge which is disposed on the support arm.

Thus, a feature of the present invention is that a guide mechanism is provided which is disposed in the interior of the bag film web between the bottom of the web and the interlocked fastener members of the web. By being placed inside the bag film web between the bottom and the interlocked fastener elements, the guide mechanism can properly laterally align the bag film so that the film is correctly placed for the feeding of the bag film into the filling portion of the packaging machine.

Another feature of the present invention is that the guide mechanism can include a first rotatable guide wheel for engaging the bottom of the bag film and a second Rotatable guide wheel for engaging the fastener elements. the use of guide wheels has the advantage of providing a relatively frictionless engagement (in the direction of the path of travel of the bag film) between the guide mechanism and the wheel. This relatively frictionless engagement reduces the guide mechanism's drag on the film. This reduction in drag is especially helpful in facilitating high speed packaging processes.

It is also a feature of the present invention that the support arm for supporting the guide mechanism immediately follows the guide wheels, and that the support arm includes the means for separating the interlocked fastener elements. By positioning the guide wheels so that they precede the separating means, the guide wheels can engage two opposed, closed inner sides of the bag film. This inner side engagement of the bag film has the advantage of providing an effective means for laterally aligning the bag film. The placement of the separating means of the support arm has the advantage of permitting the support arm to serve the dual functions of (1) supporting the guide wheels and (2) disengaging the interlocked fastener members to permit the passage of a filling chute between the fastener elements.

Additional features and advantages of the present invention will become apparent to those skilled in the art upon consideration of the following detailed description of a preferred embodiment exemplifying the best mode of carrying out the invention as presently perceived.

DETAILED DESCRIPTION OF THE PREFERRED EMBODIMENTS

Figure 1:
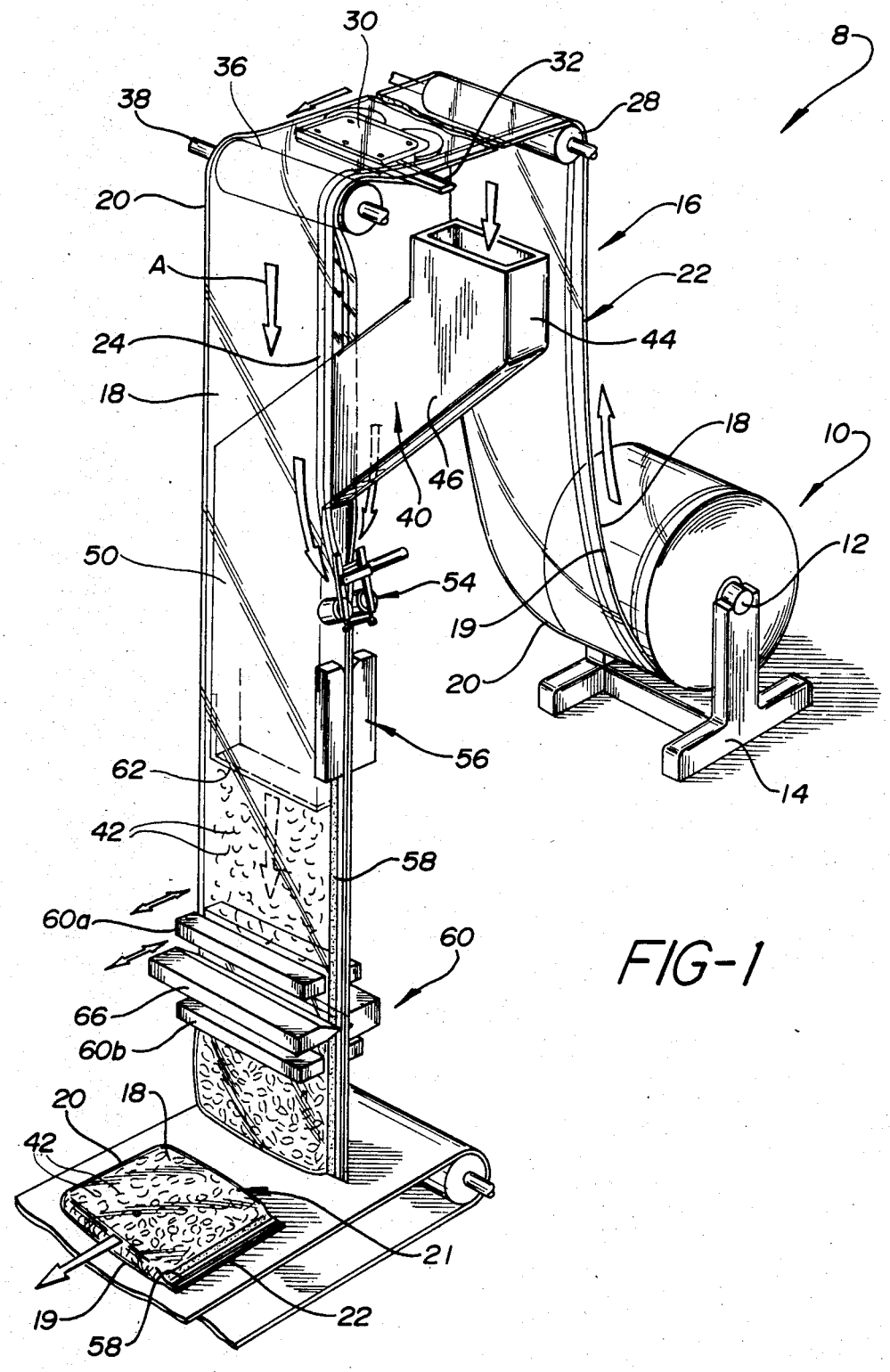
FIG. 1 is a perspective view of the form, fill and seal packaging machine of the present invention.

A form, fill and seal packaging machine 8 is shown in FIG. 1. The packaging machine 8 includes a means, such as bag film roll 10 for supplying a continuous web 16 of plastic bag film. Bag film roll 10 is supported by a spindle 12 which is rotatably journaled to a rack 14 for maintaining the roll 10 above the ground. The continuous web 16 of bag film is unwound from the roll 10 and is fed into the form, fill and seal portions of the packaging machine 8.

The web 16 is helically wound onto the roll 10, and as drawn from the roll 10 has a pair of opposed plies 18, 19. The opposed plies 18, 19 are continuous with each other at the bottom edge 20 (of the finished bag 21), and are interlocked near the top edge 22 (of the finished bag 21). The plies 18, 19 are interlocked at top edge 22 by a zipper comprising a female fastener element 24 which is formed as a part of ply 18, and a male fastener element 26 which is formed as a part of ply 19. The fastener elements 24, 26 can be similar to the fastener elements found on ZIPLOC® brand food storage bags manufactured by The Dow Chemical Company, the assignee of the instant invention. The fastener elements 24, 26 permit the finished food storage bag 21 to be reclosed after opening.

From the roll 10, the web 16 is drawn upwardly over a roller 28 by a feed mechanism (not shown) which is disposed downstream in the path of travel of the web 16. Although roller 28 is shown as a single roller, roller 28 preferably comprises a "dancer roll" system. The web 16 is then drawn through a guide mechanism 30. Guide mechanism 30 includes means for laterally aligning the web 16 and a splitting means, such as zipper-splitting edge 32 for disengaging the interlocked female and male fastener elements 24, 26. The guide mechanism 30 will be described in more detail below.

An idler roller 36 is disposed directly downstream in the bag film web's 16 path of travel from the guide mechanism 30. The idler roller 36 is positioned at about the same vertical height as guide mechanism 30, and is rotatably journaled on a spindle 38. After the fastener elements 24, 26 have been disengaged by the zipper-splitting edge 32, both plies 18, 19 of the web 16 pass over the idler roller 36. Once over the idler roller 36, the web 16 travels generally vertically downwardly. This generally vertically downward direction of travel is indicated by arrow A. Due to the action of zipper-splitting edge 32, the fastener elements 24, 26 are disengaged as the web 16 passes over idler roller 36 and begins its downward travel.

A side arm filling station, such as filling chute 40 is provided for directing product, such as cereal pellets 42 into the interior of web 16. Filling chute 40 includes a generally vertically extending upper portion 44, an angled middle portion 46 and a generally vertically extending lower portion 50. The angled middle portion 46 passes between the disengaged female and male fastener elements 24, 26 and into the interior of web 16. The generally vertically extending lower portion 50 is disposed in the interior of the web 16 between the plies 18, 19 of the web 16.

A steering, joining, and closing mechanism 54 for pressing together and re-interlocking the female and male fastener elements 24, 26 of the opposed plies 18, 19 is disposed in the path of travel of the web 16 directly downstream of the angled middle portion 46. More particularly, the steering, joining and closing mechanism 54 is disposed downstream of that portion of the angled middle portion 46 of filling chute 40 which passes between the fastener elements 24, 26. Although the steering, joining and closing mechanism 54 is disposed downstream of the angled portion 46, it is also disposed at the same general point in the direction of travel of the web 16 as a portion of the generally vertically extending lower portion 50 of the feed chute 40. An example of such a steering, joining and closing mechanism 54 is described in more detail in an application by the same inventors entitled "Steering, Joining and Closing Mechanism for Zippered Film on a Vertical Form-Fill-Seal Machine," which is being filed simultaneously with the instant application.

A reciprocally moving, generally vertically extending seal forming bar 56 is disposed downstream of the steering, joining and closing mechanism 54. Seal forming bar 56 is provided for forming a temporary "peel seal" 58. In the finished bag 21, the peel seal 58 is formed interiorly of, and generally parallel to the fastener elements 24, 26. The peel seal 58 can be unsealed by the user without destroying the integrity of the finished bag 21. The peal seal 58 helps to make the finished bag 21 more tamper resistant. Preferably, the length of seal forming bar 56 is approximately equal to the width of the finished bag 21.

A reciprocally moving, generally horizontally disposed seal forming 60 means having sealing bar elements 60*a* and 60*b* is disposed below the open lower end 62 of the feed chute 40. Preferably, seal forming means 60 is disposed at a distance from the open lower end 62 of the feed chute 40 which is approximately equal to the width of one finished bag 21. Sealing bar elements 60*a* and 60*b* are provided for laterally sealing together the first and second plies 18, 19 to form the side seals of the finished bag 21.

A severing means 66 is disposed between sealing bar elements 60*a* and 60*b*. The severing means 66 is provided for severing the intermittently sealed continuous web 16 into individual, finished bags 21.

Figure 2:
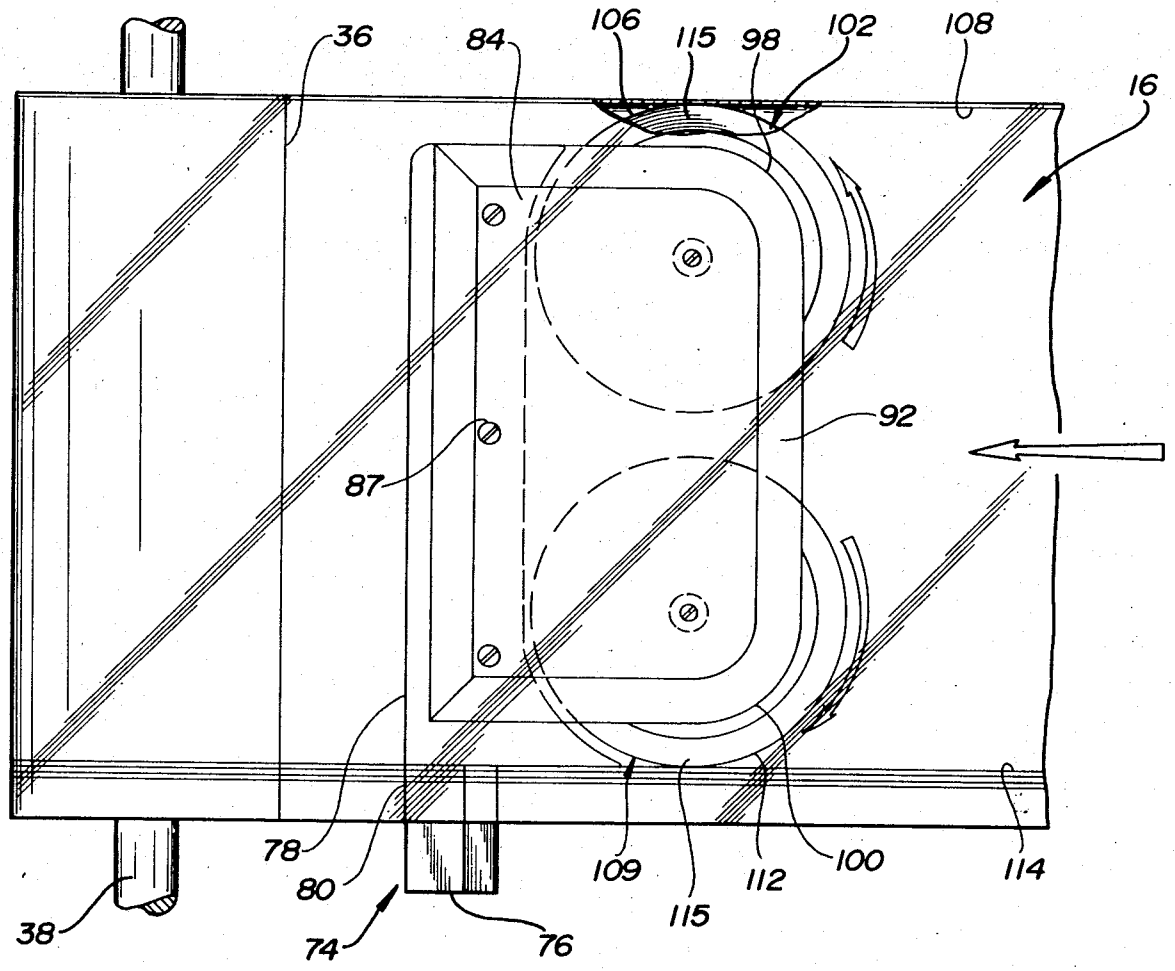
FIG. 2 is a top plan view of the guide mechanism of the present invention.
Figure 3:
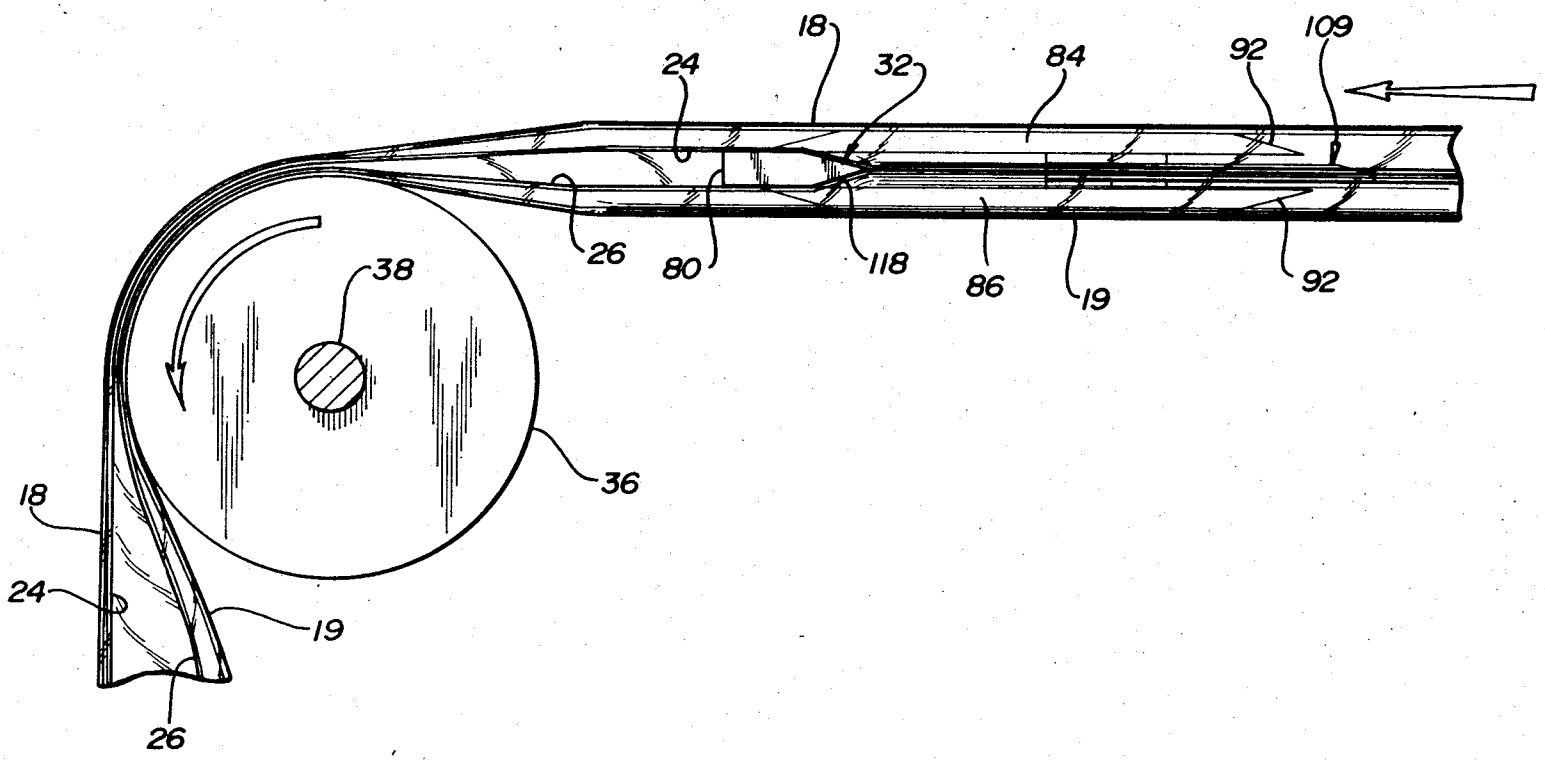
FIG. 3 is a side view of the guide mechanism of the present invention.
Figure 4:
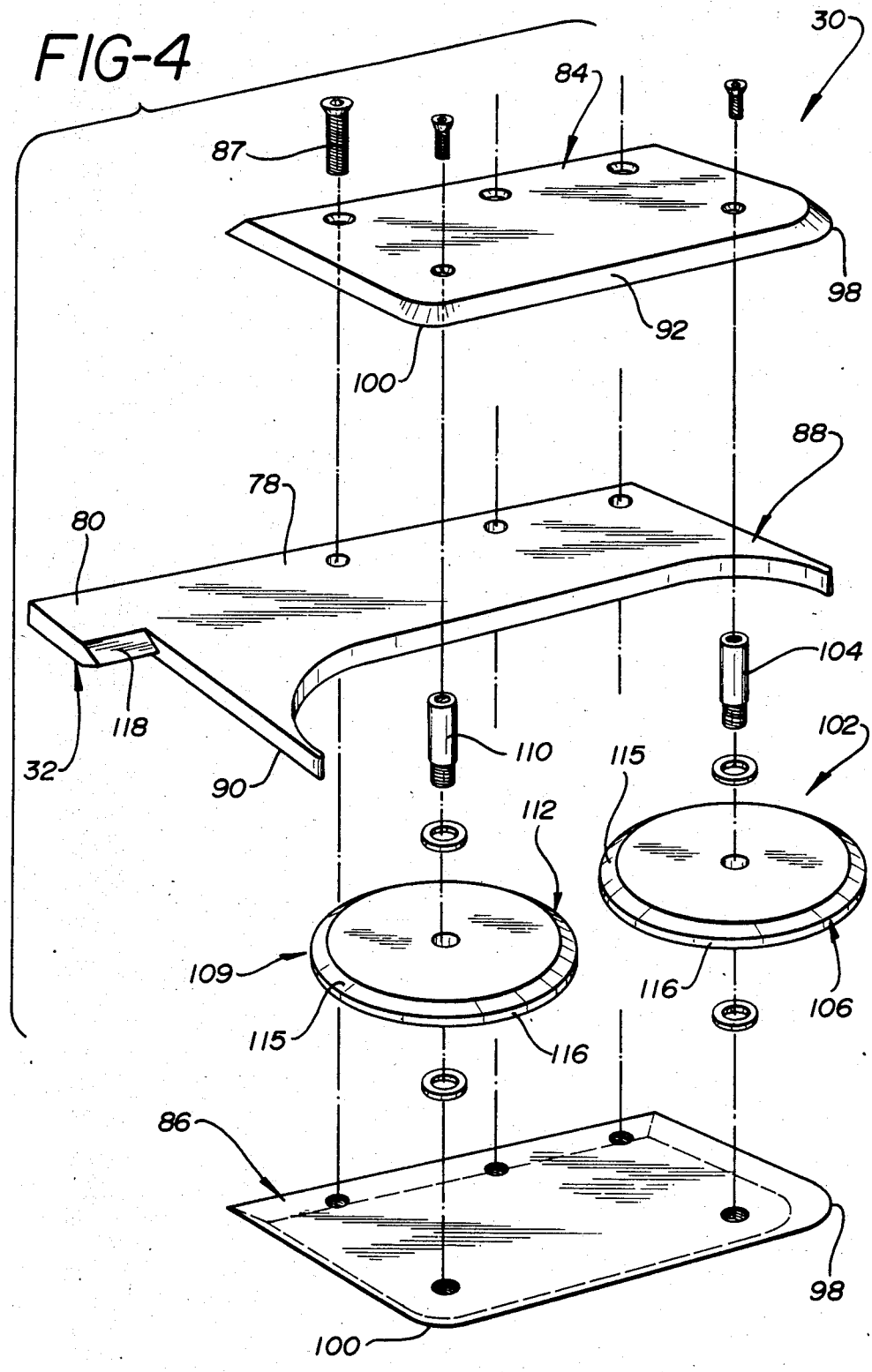
FIG. 4 is an exploded view of the guide mechanism of the present invention.

The guide mechanism 30 of the present invention is best shown in FIGS. 2–4. The mechanism 30 includes a support arm 74 for supporting the various components of the guide mechanism 30. The support arm 74 can be connected to a portion (not shown) of the form, fill and seal packaging machine 8, can be supported by an independent stand (not shown) or can be formed to include an integral stand (not shown).

The support arm 74 includes an exterior portion 76 disposed exteriorly of the bag film web, an interior portion 78 disposed interiorly of the bag film web 16, and an intermediate portion 80. The intermediate portion 80 is disposed in the path of travel of the fastener elements 24, 26 and passes between the fastener elements 24, 26 of the bag film web 16 as the web 16 is advanced.

An upper bracket member 84 and a lower bracket member 86 are attached by screws 87 to the respective upper surface 88 and lower surface 90 of the interior portion 78 of the support arm 74. The bracket members 84, 86 are disposed in a plane generally parallel to the plies 18, 19 of the bag film web, and extend generally upstream in the direction of travel of bag film web 16 from the support arm 74.

The bracket members 84, 86 each include a beveled peripheral lip 92, which extends along the forward and side edges of the bracket members 84, 86. The beveled peripheral lip 92 facilitates the passage of the plies 18, 19 over the bracket members 84, 86, and reduces the likelihood of the plies 18, 19 becoming snagged on the respective bracket members 84, 86.

The bracket members 84, 86 each also include a first rounded forward corner 98 and a second rounded forward corner 100. The rounded corners 98, 100 and beveled peripheral lip 92 combine to form a guide mechanism 30 which is tapered about all web contacting edge peripheries. This dual tapering helps to prevent the plies 18, 19 from becoming snagged on the guide mechanism 30.

A first guide wheel 102 is rotatably journaled by an axle 104 to both the upper and lower bracket members 84, 86, and is disposed therebetween. The axis about which the first guide wheel 102 rotates is generally perpendicular to the plane of the plies 18, 19 of the bag film web 16. The first guide wheel 102 is sized and positioned so that its bag film engaging surface 106 engages the bottom 108 of the interior surface of the bag film web 16.

A second guide wheel 109 is rotatably journaled by an axle 110 to both the upper and lower bracket members 84, 86 and is disposed therebetween. The axis about which second guide wheel 109 rotates is parallel to the axis about which first guide wheel 102 rotates, with both being perpendicular to the plane of the plies 18, 19 of the bag film web 16. Second guide wheel 109 is sized and positioned so that its bag film engaging surface 112 engages the interior surface 114 of the fastener elements 24, 26 while the fastener elements 24, 26 are interlocked. The second guide wheel 109 preferably exerts a sufficient force against the interior surface 114 of the fastener elements 24, 26 to align the web 16 properly, without putting enough force on the interior surface 114 of the fastener elements 24, 26 to cause the fastener elements 24, 26 to become disengaged.

The bag film engaging surfaces 106, 112 of the guide wheels 102, 109 are best shown in FIGS. 2 and 4, as being beveled surfaces. The bag film engaging surfaces 106, 112 each include a relatively larger beveled surface 115 and a relatively smaller right cylindrical surface 116. Although rounded or squared off bag film engaging surfaces can be used, beveled bag film engaging surfaces 106, 112 enchance the performance of the first and second guide wheels 102, 109 and especially enhance the performance of second guide wheel 109. The applicants have found that a beveled bag film engaging surface 112 can exert a relatively greater force against the interior surface 114 of the fastener elements 24, 26 (without disengaging the fastener elements 24, 26) than a rounded or squared off bag film engaging surface.

The applicants have also found that the best results are obtained by placing the larger surface 115 of the beveled bag engaging surface 112 against the female fastener element 24. In one testing session, the applicants found that by placing the female fastener element 24 against the larger beveled surface 115, the fastener elements 24, 26 could withstand an average of 18.8 pounds of force without becoming disengaged. when the male fastener element 26 was placed against the larger beveled surface 115, the fastener elements could withstand an average of 9.3 pounds of force without becoming disengaged. When a rounded bag film engaging surface (i.e. without guide wheels) (not shown) was employed, the applicants found that the fastener elements 24, 26 could withstand an average of 9.8 pounds of force without becoming disengaged.

This ability of a beveled bag film engaging surface to exert increased force helps the guide mechanism 30 to perform its function of laterally aligning the bag film web 16 without disengaging the fastener elements 24, 26. Although a beveled bag film engaging surface 106 can be used with first guide wheel 102, the configuration of the bag film engaging surface 106 of the first guide wheel 102 is not as important to the performance of the guide mechanism 30 as the configuration of the bag film engaging surface 112 of the second guide wheel 109.

Preferably, the guide wheels 102, 109 are constructed of a material such as stainless steel.

In an alternate embodiment (not shown) the guide wheels 102, 109 can be eliminated and the bracket members 84, 86 can be sized and positioned to serve as a stationary edge means for aligning the bag film web. In such an embodiment, the first forward corners and sides of the bracket members would engage the bottom 106 of the interior surface of the bag film, and the second forward corners and sides of the bracket members would engage the interior surface 114 of the fastener elements. Similar to bracket members 84, 86, the bracket members of this alternate embodiment should have a corner and edge configuration which provides the guide mechanism a forward portion tapered about an axis both parallel and perpendicular to the plane of the plies 18, 19 of the bag film web 16.

The zipper splitting edge 32 is formed as a part of the intermediate portion 80 of the support arm 74, and comprises the forward edge 118 of the support arm 74 being beveled on its upper and lower surfaces. Alternately, the zipper splitting edge 32 can comprise a separable beveled member (not shown) which is mounted to the intermediate portion 80 of the support arm 74.

In operation, the engagement of the first guide wheel 102 with the bottom surface 108 of the bag film web 16, and the engagement of the bag film engaging surface 112 of the second guide wheel 109 with the interior surface 114 of the fastener elements 24, 26 cooperate to place the bag film web 16 in its proper lateral alignment. The rotatability of the guide wheels 102, 109 performs this lateral alignment with a relatively small amount of frictional engagement, thus reducing the drag of the guide mechanism 30 on the bag film web 16. After the second guide wheel 109 engages the interlocked fastener elements 24, 26 to laterally align the bag film web 16, the fastener elements 24, 26 are advanced to engage the zipper splitting edge 32, wherein they are disengaged.

In this manner, it is possible to utilize the engaged fastener elements 24, 26 to laterally align the bag film web 16 and to separate the bag film elements after bag film web 16 has been aligned. It has been found by applicants that the system described above provides an efficient guiding and zipper splitting mechanism for a forming, filling and sealing machine for zippered bags.

Having described the invention in detail, and by reference to the preferred embodiments thereof, it will be apparent that modifications and variations are possible without departing from the scope of the invention defined in the appended claims.

What is claimed is:

1. A form, fill and seal packaging machine comprising:

means for supplying a continuous plastic bag film in a tubular configuration having interlocked recloseable fastener elements on respective opposing plies of said film, means for feeding said film through a filling station, a filling station for supplying a predetermined amount of product to said bag film, guide means immediately preceding said filling station and position inside said bag film for providing uninterrupted guidance of said film through said filling station, said guide means includes a first guide wheel for engaging an interior surface of said bag film and a second guide wheel for engaging said fastener elements, separating means preceding said filling station for separating said fastener element, a support arm for supporting said guide means and said separating means, wherein said support immediately follows said guide wheel and said separating means on said support arm is positioned between the fastener elements, means for pressing said fastener elements together in an interlocking relationship, means for laterally sealing said bag film to form a bag assembly having first and second side seams, and means for severing said bag assembly from said bag film.

2. The invention of claim 1 wherein said guide means includes a first edge means for engaging an interior surface of said bag film opposite said fastener elements and a second edge means for engaging said fastener elements.

3. The invention of claim 2 wherein said first edge means comprises a first guide wheel having an axis generally perpendicular to the plane of the bag film, and said second edge means comprises a second guide wheel having an axis generally perpendicular to the plane of said bag film.

4. The invention of claim 3 wherein said second guide wheel comprises a beveled guide wheel.

5. The invention of claim 2 wherein said first and second edge means comprise first and second stationary edge means.

6. The invention of claim 5 wherein said first and second edge means each include a tapered forward portion.

7. The invention of claim 1 wherein said second guide wheel includes a beveled, fastener element engaging surface.

8. The invention of claim 1 wherein said first and second guide wheels each include a beveled bag film engaging surface and have an axis generally perpendicular to the plane of the bag film.

9. The invention of claim 1 wherein said guide means includes a bracket member connected to said support arm for rotatably supporting said guide wheels.

10. The invention of claim 1 wherein said guide means comprises:

a bracket member connected to said support arm and disposed between the plies of said bag film, a first guide wheel rotatably coupled to said bracket member for engaging the bottom of said bag film, and a second guide wheel rotatably coupled to said bracket member for engaging said fastener elements.

11. The invention of claim 10 wherein said separating means comprises a separating edge disposed on said support arm and wherein the first and second guide wheels are positioned to immediately precede said separating edge.

12. An apparatus for providing uninterrupted guidance through a forming station of a reclosable bag film in a tubular configuration having interlocked fastener elements comprising:

a guide means positioned inside said bag film for providing uninterrupted guidance of said bag film through said forming station including a first guide wheel engaging an interior surface of said bag film and a second guide wheel having a beveled fastener element engaging surface for engaging interlocked fastener elements on opposing plies of said bag film, said first and second guide wheels having an axis of rotation generally perpendicular to the faces of said bag film, and separating means positioned along the path travelled by said bag film for separating said interlocked fastener elements as said bag film is advanced.

* * * * *